US005084943A

United States Patent [19]

DeCanio

[11] Patent Number: 5,084,943

[45] Date of Patent: Feb. 4, 1992

[54] FLAT FILE HOODED GAS LIGHTER FASTENING DEVICE

[76] Inventor: Paul J. DeCanio, 49 Greis Ave., Lake Ronkonkoma, N.Y. 11779

[21] Appl. No.: 592,627

[22] Filed: Oct. 4, 1990

[51] Int. Cl.[5] ..... A44B 21/00

[52] U.S. Cl. ..... 24/3 L; 24/303; 24/710.1; 431/267; 431/273; 431/274

[58] Field of Search ..... 431/253, 273, 274, 275, 431/276, 343, 124, 267; 24/3 L, 3 J, 342, 710.1

[56] References Cited

U.S. PATENT DOCUMENTS

| | | | |
|---|---|---|---|
| 1,408,288 | 2/1922 | Grimm | 431/273 X |
| 1,490,262 | 4/1924 | Fuller | 431/276 |
| 2,642,999 | 6/1953 | McPherson | 24/303 X |
| 2,644,212 | 7/1953 | Markowitz | 24/303 X |
| 3,139,690 | 7/1964 | Hait | 24/303 X |
| 3,494,244 | 2/1970 | Wayland | 24/453 X |
| 3,831,225 | 8/1974 | Bengtsson | 24/453 |

FOREIGN PATENT DOCUMENTS

| | | | |
|---|---|---|---|
| 614715 | 6/1935 | Fed. Rep. of Germany | 431/273 |
| 578615 | 7/1946 | United Kingdom | 431/276 |

*Primary Examiner*—Carl D. Price

[57] ABSTRACT

A device for attaching a flat file hooded gas lighter to an accessible location. The device includes a body structure having a magnet on one end and a fastening clip on the other end and groove like threads and a stop flange therebetween. The body structure maybe conveniently made from a plastic material.

2 Claims, 1 Drawing Sheet

FIG 1
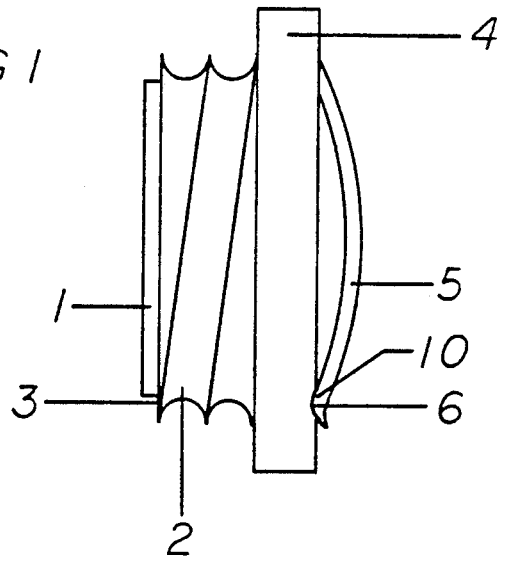
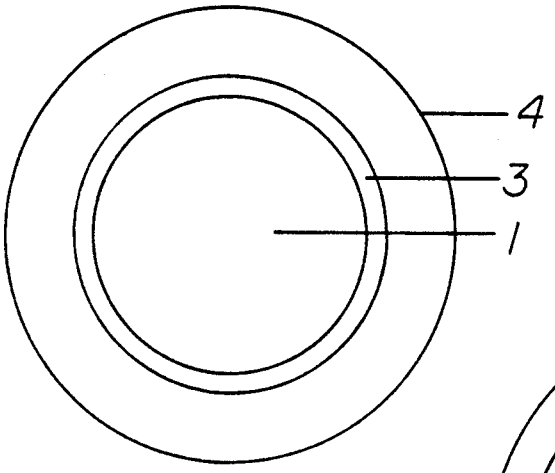
FIG 2
FIG 3
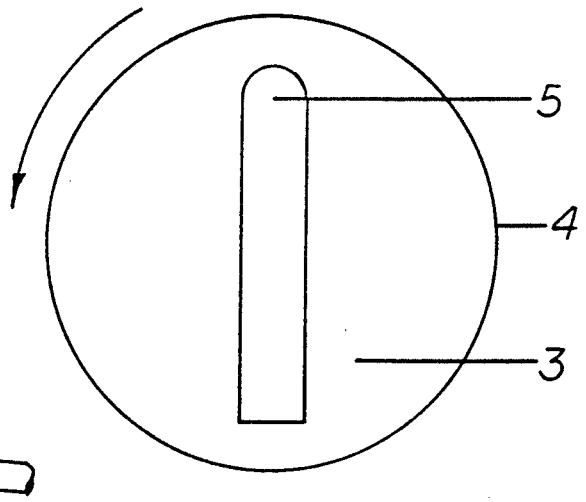
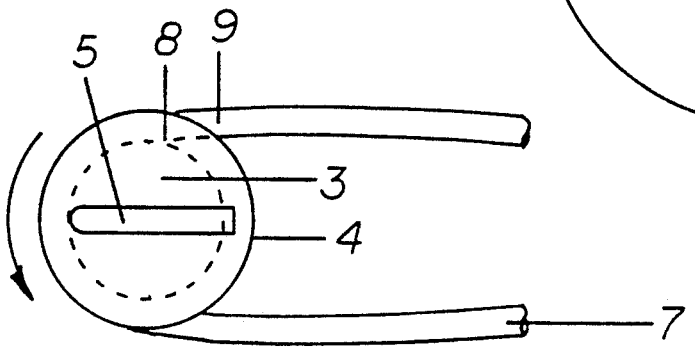
FIG 4

FLAT FILE HOODED GAS LIGHTER FASTENING DEVICE

BACKGROUND OF THE INVENTION

The invention relates generally to a device that allows flat file hooded gas lighters to be removably fastened to the operators belt, ferrous surfaces or ambient structures.

Flat file hooded gas lighters currently in use have no fastening means and tend to drop from the work site often damaging the gas lighter and most importantly interrupt the torch operator from performing his duties. This invention eliminates this problem.

SUMMARY OF THE INVENTION

It is an object of this invention to provide an inexpensive means of fastening a gas lighter to a desired location.

It is another object of this invention to provide a fast effortless means of fastening the gas lighter within reach of the torch operator, which will increase worker productivity.

BRIEF DESCRIPTION OF THE DRAWINGS

Referring to the drawings:

FIG. 1 is a front plan view showing an embodiment of the flat file hooded gas lighter fastening device.

FIG. 2 is a left side plan view showing an embodiment of the flat file hooded gas lighter fastening device.

FIG. 3 is a right side plan view of the flat file hooded gas lighter fastening device.

FIG. 4 is a plan view showing an embodiment of the flat file hooded gas lighter fastening device completely installed in a gas lighter.

DESCRIPTION OF THE PREFERRED EMBODIMENT

Referring to FIGS. 1,2,3, and 4 an embodiment of the invention is shown in which the flat file hooded gas lighter fastening device is installed in the double loop 8, of the gas lighter 7, as shown in FIG. 4. The flat file hooded gas lighter fastening device is comprised of a body structure 3, that have two fastening means, a magnet 1, on one side and a fastening clip 5, on the stop flange 4, side, which at the open end of the fastening clip 5, has a nodule (10) which fits into a fastening clip notch 6, which holds the fastening clip 5, during installation and also acts as a fastener all being integrally connected to the body structure 3.

The body structure 3, also has thread like grooves 2, which coinside with the inner surface pattern of the double loop 8, means for turning the device in the proper direction which when the stop flange 4, makes contact with the bottom surface 9, of the gas lighter 7, the device is completely in the installed position. All embodiments of this invention would function to keep a gas lighter in a desired location.

Although one detailed embodiment of the invention is illustrated in the drawings and previously described in detail, this invention contemplates any configuration, design and relationship of components which will function in a similar manner and which will provide the equivalent result.

I claim:

1. A device for removably fastening a double loop flat file hooded gas lighter to a desired location which comprises:

(A) a body structure including on its external surface a continuous thread like groove extending from a first end surface of the body;

the first end surface includes a magnet permanently mounted thereon;

the second end surface is defined in part by a disc shaped stop flange which extends radially beyond said external surface continuous groove terminating at a location adjacent to an inside surface of the flange, said inside surface facing toward the first end surface of the body, the second end surface having attached thereon a fastening clip, (B) said magnet comprises a disc like shaped element having a diameter which is smaller than that of said first end surface, (C) said fastening clip comprises a rectangular convex shaped element having a closed first clip end fixed to the second end surface and an open second clip end including a nodule which is arranged to engage a fastening clip notch located in the second end surface, said fastening clip arranged for keeping continuous biased tension against the second end surface of the body, (D) said stop flange has a diameter greater than that of the outer surface of a double loop portion of said lighter, (E) whereby the device is attached to the flat file hooded gas lighter by engagement of said threads in a counter clockwise direction with the double loop of the lighter, which defines matching threads, and turned until the stop flange inside surface comes in to contact with the outer surface of the double loop, the body structure length is defined to allow the magnet to protrude past the double loop to allow the magnet to make contact with any ferrous support surface, the open second clip end being positioned to face in the direction of the hood of said gas lighter to allow the fastening clip, in a clipped mode, to hold the gas lighter in an inverted position.

2. A device as recited in claim 1, wherein the body structure is made of a plastic material and wherein said magnet is molded therein.

* * * * *